US005669128A

United States Patent [19]

Futamura et al.

[11] Patent Number: 5,669,128

[45] Date of Patent: Sep. 23, 1997

[54] INDEX-FEED MACHINING SYSTEM

[75] Inventors: Shoji Futamura; Keizo Unno, both of Kawasaki, Japan

[73] Assignee: Institute of Technology Precision Electrical Discharge Work's, Kanagawa-ken, Japan

[21] Appl. No.: 534,099

[22] Filed: Sep. 26, 1995

[30] Foreign Application Priority Data

Sep. 30, 1994 [JP] Japan ..... 6-236238

[51] Int. Cl.[6] ..... B21J 9/14

[52] U.S. Cl. ..... 29/33 Q; 29/33 S; 29/34 R; 72/442; 72/447; 72/453.03; 72/472; 100/257

[58] Field of Search ..... 72/442, 444, 446, 72/447, 452.5, 453.02, 453.03, 472; 29/33 S, 34 R, 33 Q, 33 K; 100/257

[56] References Cited

U.S. PATENT DOCUMENTS

| | | | |
|---|---|---|---|
| 3,482,487 | 12/1969 | Leffers | 92/176 |
| 3,783,672 | 1/1974 | Morgolenko et al. | 72/407 |
| 4,148,209 | 4/1979 | Bessho | 72/441 |
| 4,321,818 | 3/1982 | Bessho | 72/453.02 |
| 4,977,773 | 12/1990 | Mito et al. | 72/353.6 |
| 5,036,574 | 8/1991 | Kakimoto | 39/335 |
| 5,271,140 | 12/1993 | Futamura et al. | 29/33 K |
| 5,499,525 | 3/1996 | Kordak et al. | 72/453.03 |

*Primary Examiner*—Daniel W. Howell
*Assistant Examiner*—Christopher Kirkman
*Attorney, Agent, or Firm*—McGlew and Tuttle

[57] ABSTRACT

An index-feed machining system comprising a plurality of machining units, each having a cassettes having a plurality of machining means and detachably fitted to a machining unit proper, disposed at intervals of mP (m being a given positive integer, and P being a feeding pitch of a workpiece) in a direction in which the workpiece is fed to sequentially machining the workpiece that is index-fed at the feeding pitch of mP, in which a ram is vertically movably provided on an upper end of the machining unit proper constituting the machining unit, a hydraulic cylinder is provided in the machining unit or the ram, a piston is vertically movably provided in the hydraulic cylinder, an actuating unit comprising an eccentrically rotating shaft and the piston that can be engaged with each other via a connecting rod or via a connecting rod and the ram, is provided above the machining unit, and a hydraulic circuit is provided so that operating fluid can be selectively introduced from the hydraulic circuit to an upper part or lower part of the piston so as to cause the ram and the machining means to be engaged or disengaged with each other.

15 Claims, 7 Drawing Sheets

INDEX-FEED MACHINING SYSTEM

FIELD OF THE INVENTION

This invention relates generally to an index-feed machining system in which when a workpiece is subjected to punching, bending, drawing and other machining operations, the entire machining processes are performed in a single system by sequentially index-feeding the workpiece to the succeeding process to add a machining to the workpiece until the entire machining operations are completed with the final process, and more particularly to an index-feed machining system having a simple construction of actuating unit and involving small working energy.

BACKGROUND OF THE INVENTION

When a sheet-metal product of a predetermined shape is manufactured by subjecting a sheet material, such as a steel sheet, to punching, bending, drawing, compressing and other machining operations, several processes are usually involved. If a large number of sheet-metal products are to be manufactured, each machining process or stage is performed individually on a workpiece in a single machining mold, and then the workpiece is fed to the next machining step to perform additional machining on it until all machining steps are completed. The type of machining mold used in such a system is generally referred to as the index-feed machining mold. The index-feed machining mold is highly efficient because a single sheet-metal product can be obtained in one stumping operation of a press, for example.

The prior-art index-feed machining mold has a number of advantages of high production rate, shorter product delivery from the start of machining on a workpiece to the completion of machining, less works-in-process involved in the intermediate processes, and mass production with a small number of operators, bug it has the following disadvantages. As multiple pairs of punches and dies have to be incorporated in a single index-feed mold, the construction of mold becomes complicated, requiring high-precision mold manufacturing technology. This leads to long manufacturing period and high manufacturing cost.

Furthermore, when repairing and adjusting a partially damaged mold, the entire mold has to be disassembled and these repairing, and adjusting operations are quite troublesome, requiring much time and trouble. In addition, when workpieces having slightly different shapes and dimensions are used to produce a wide variety of products in a small quantity, molds for such different product shapes and sizes have to be manufactured, resulting in increased mold cost. Thus, the prior-art index-feed machining moid cannot be used for the so-called flexible manufacturing system (FMS) which has been gaining popularity in recent years.

To overcome these problems, the present applicant has filed patent applications for index-feed machining systems that have simple constructions and can easily perform partial adjustment and other operations (Japanese Patent Application Nos. Hei-2(1990)-121760 and Hei-2(1990)-121761).

FIG. 1 is a perspective view of an example of index-feed machining system on which this invention is based. In FIG. 1, numerals 100–500 refer to machining units, respectively disposed on a base 1 at intervals of 2P (P being a feeding pitch of the workpiece), for example, in a direction in which a workpiece. (not shown) is fed. These machining units 100–500 have pairs of punches and dies corresponding to a plurality of machining processes. Now, the construction of the machining units will be described taking a machining unit 100 as an example.

Numeral 101 refers to a machining unit proper formed in an essentially U shape and having a dovetail 102 integrally formed at the lower end thereof, which is engaged with a dovetail groove 103 provided on the base 1 so that the movement of the machining unit 101 in the workpiece feeding direction can be adjusted and the movement of the workpiece in a direction vertical to the workpiece feeding direction can be restricted.

Numeral 104 refers to a movement adjusting device, 105 to a clamp device, and 106 to a hydraulic cylinder provided on the upper end of the machining unit proper 101. Numeral 107 refers to a position measuring device provided on the side of the hydraulic cylinder 106.

Next, numeral 108 refers to a cassette formed in essentially U shape and having a punch or die (neither of which is shown in the figure) on the upper part thereof in a vertically movable manner, and a die or punch (neither of which is shown in the figure) mating to the aforementioned punch or die provided on the lower part thereof in such a manner as to de detachable to the machining unit proper 101. The cassette 108 is positioned by engaging the cassette 108 with positioning members 309 and 310, as shown with reference to a machining unit 300. Numeral 111 refers to a clamp screw. That is, the cassette 108 can be positioned at a predetermined position by mounting the cassette 108 on the machining unit proper 101 via the positioning members (not shown. Refer to numerals 309 and 310 in reference to the machining unit 300), and fixedly fitted at that position by tightening the clamp screw 111. After the cassette 108 has been locked in position, an actuating rod (not shown) of the hydraulic cylinder 106 is connected to a punch or die provided in a vertically movable manner, as described above.

FIGS. 2A and 2B are plan and cross-sectional views illustrating an example of the machining state of a workpiece. Like parts are indicated by like numerals shown in FIG. 1. In FIGS. 2A and 2B, numeral 2 is a workpiece which is index-fed intermittently at a pitch of P in the direction shown by an arrow. That is, the workpiece 2 is index-fed in a gap between a pair of punch and die provided on the cassette 108 (the same applies to other cassettes). In FIGS. 1, and 2A and 2B, the machining units 100–500 are provided to take care of the process for machining pilot holes 3, the process for machining circular-arc-shaped slits 4 and the processes for the first and third drawing operations.

The machining unit 100 has a punch and a die for providing pilot holes 3, and guides (not shown) for engaging with the pilot holes 3 at position P on the downstream side in the direction in which the workpiece 2 is fed. Consequently, as the machining unit 100 is operated to sequentially punch the pilot holes 3, the guides are engaged with the punched pilot holes 3 to prevent the workpiece 2 from being unwantedly displaced, maintaining machining accuracy.

Circular-arc-shaped slits 4 are then provided on the workpiece 2 in the machining unit 200. In the machining unit 300, the first drawing operation is performed to form a cup-shaped projection 5 on the workpiece 2, while the circular-arc-shaped slits 4 are expanded in width into circular-arc-shaped grooves 6. In the machining unit 400, the second drawing operation is performed and flange holes 7 are provided, and the height of the projection 5 is increased. In the machining unit 500, the third drawing operation is performed and the height of the projection 5 is further increased into a predetermined size. Though not shown in the figure, trimming and other operations are also carried out to obtain a sheet-metal products of a predetermined cup shape. In the machining units 200–500, too, positioning is accomplished with the aid of the guides provided to engage with the pilot holes 3 to maintain a predetermined degree of accuracy.

The index-feed machining system having the aforementioned construction is simpler in construction than the prior-art index-feed mold, easy to manufacture and can perform highly efficient machining even in a production setup for producing a wide variety of products in small quantities, but it has the following problems.

The machining units 100–500 are caused to operate by a hydraulic cylinder 106 and others provided on the upper part thereof. In general, the hydraulic cylinder is slower in operating speed due to its construction, compared with other mechanically actuating device, such as the crank mechanism. This results in slow machining speed as the system as a whole.

Furthermore, the fact that each of the machining units 100–500 has its own hydraulic cylinder independently makes it possible to selectively put any machining unit into an inoperative state, while a larger amount of operating fluid is required to feed each hydraulic cylinder. This leads to an increase in the capacity of hydraulic pumps constituting a hydraulic unit, and to an increase in required energy.

Moreover, a machining unit proper (refer to numeral 101 in FIG. 8, for example) constituting a machining unit must be of a sturdy construction since a reaction force to the hydraulic cylinder 106 is exerted on the machining unit proper when the hydraulic cylinder 106 is actuated. This would increase the size of the machining unit proper 101 and others, and that of the index-feed machining system.

SUMMARY OF THE INVENTION

This invention is intended to overcome the problems inherent in the prior art. It is an object of this invention to provide an index-feed machining system requiring less energy for its actuating device and having a compact construction.

To accomplish these objectives, this invention employs an index-feed machining system having a plurality of machining units disposed in the aforementioned manner, in which a ram is vertically movably provided on an upper end of the machining unit proper constituting the machining unit, a hydraulic cylinder is provided in the machining unit or the ram, a piston is vertically movably provided in the hydraulic cylinder, an actuating unit comprising an eccentrically rotating shaft and the piston that can be engaged with each other via a connecting rod or via a connecting rod and the ram, is provided above the machining unit, and a hydraulic circuit is provided so that operating fluid can be selectively introduced from the hydraulic circuit to an upper part or lower part of the piston so as to cause the ram and the machining means to be engaged or disengaged with each other.

As an actuating device for this invention, a mechanical press (crank press) construction using a crank mechanism, that is, a construction in which a clutch is provided in such a manner that drive power can be selectively transmitted to a rotating crank shaft and the rotation of a flywheel is transmitted to the crank to impart linear motion to a ram connected to the crank via a connecting rod can be used.

In addition, a crankless type in which a ram is actuated by an eccentric disc or an eccentric wheel, instead of a crank, can be used to increase the flexural stiffness of the aforementioned crank portion, or the torsional stiffness of the transmission shaft system. The crankless type is favorable for forming operations involving a long forming stroke, or drawing operations.

A hydraulic circuit having a pressure control valve or a relief valve can be provided, which is designed to keep the pressure in the hydraulic circuit at a preset value by releasing excess operating fluid when a pressure above a predetermined level is exerted on the operating fluid introduced into the lower part of the piston.

With the above-mentioned construction, the machining speed of the system as a whole can be increased since each of the machining units can be operated at high speed. By adopting a construction in which the operating fluid from the hydraulic circuit can be selectively introduced into the upper part of the piston, any machining unit can be brought into an inactive state. That is, when operating fluid is introduced into the upper part of the piston and not introduced into the lower part of the piston, the relative position of the ram with the piston rises, causing the ram to move vertically by the action of the crank or the eccentric wheel while being disengaged from the machining means constituting the machining unit. This can put any machining unit into ah inactive state.

When operating fluid is introduced into the lower part of the piston, the relative position of the ram with the piston lowers, bringing the machining unit into an active state to perform predetermined index-feed machining. In this case, the operating fluid introduced into the lower part of the piston serves as a cushion medium against the energizing or pressurizing action of the ram to the machining unit, reducing the impact during machining.

By employing a construction in which operating fluid is discharged to a tank via a pressure control valve or a relief valve when the pressure of the operating fluid in the lower part of the piston falls below the preset pressure, the operation of the ram is discontinued when foreign matter enters in a machining unit, preventing the component members from being unwantedly damaged.

DETAILED DESCRIPTION OF THE EMBODIMENTS

Figure 1:
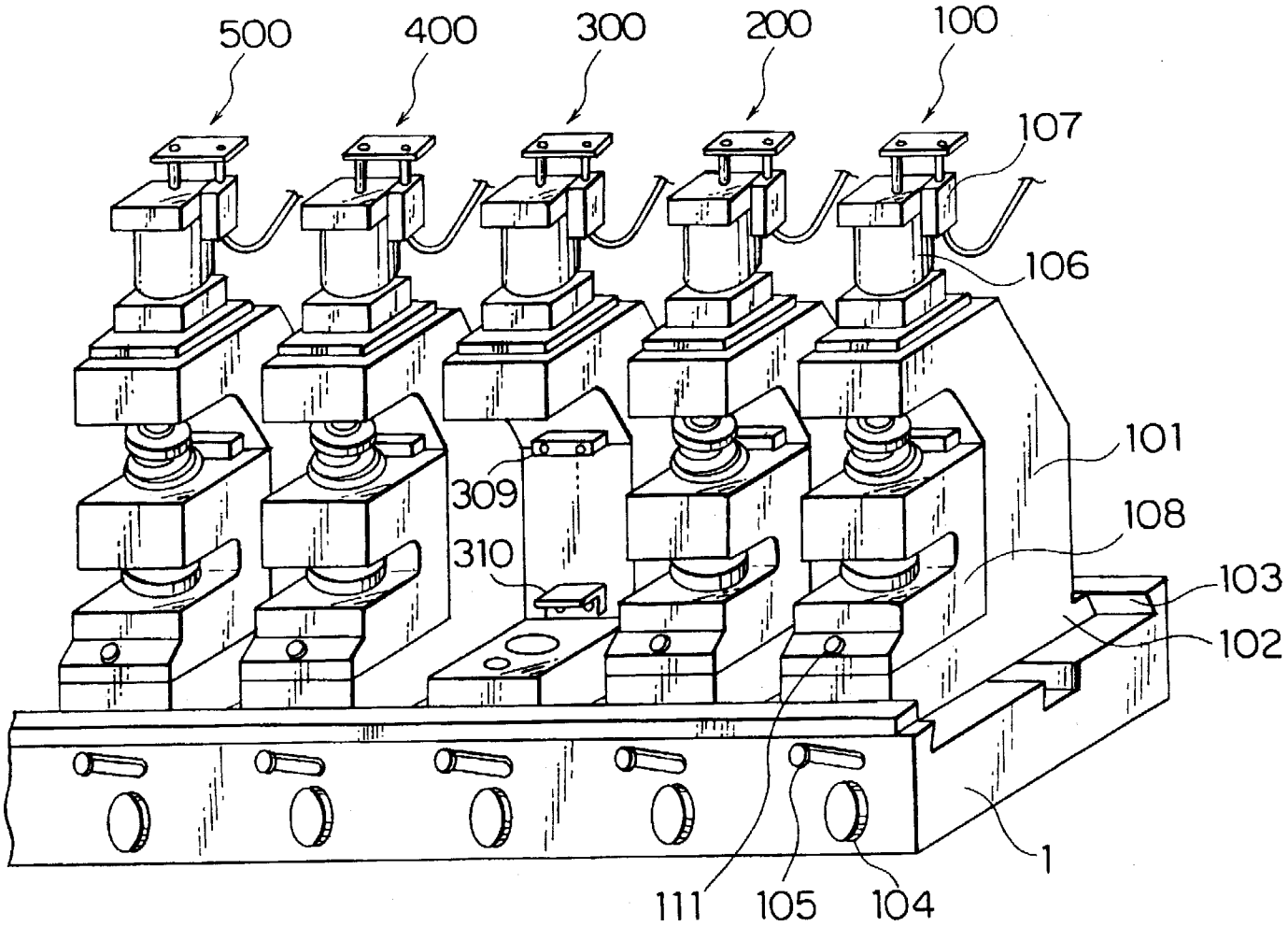
FIG. 1 (PRIOR ART)
FIG. 1 is a perspective view of an index-feed machining system on which this invention is based.
Figure 2A:
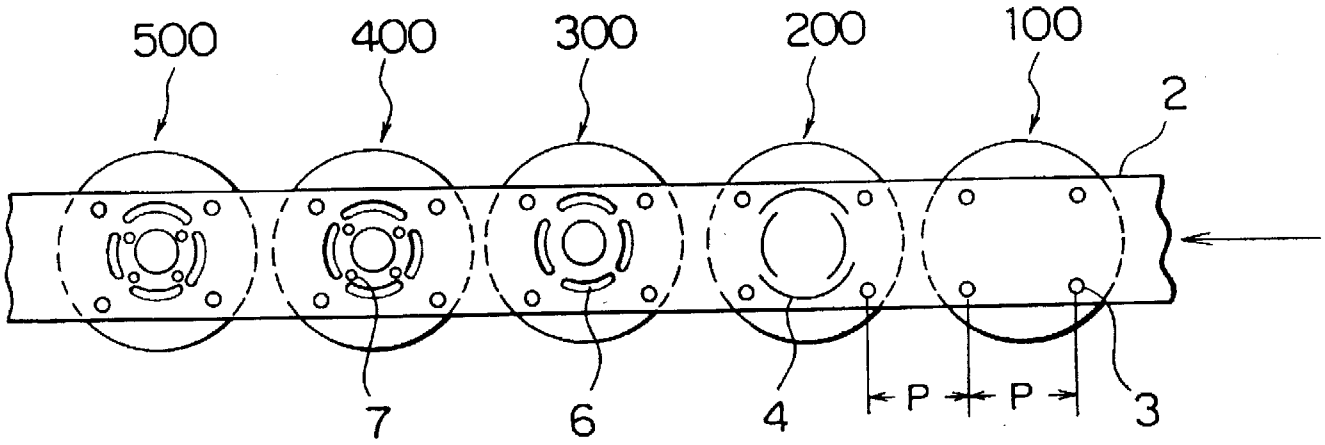
FIG. 2A (PRIOR ART)
FIGS. 2A and 2B are a plan view and a cross-sectional view illustrating the state where a workpiece is machined.
Figure 2B:
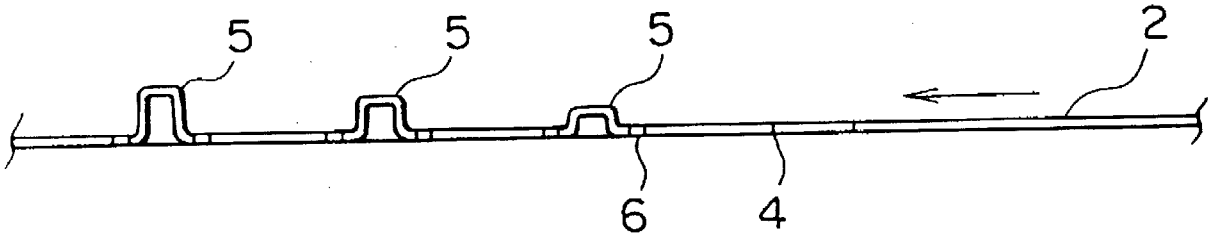
FIG. 2B (PRIOR ART)
Figure 3:
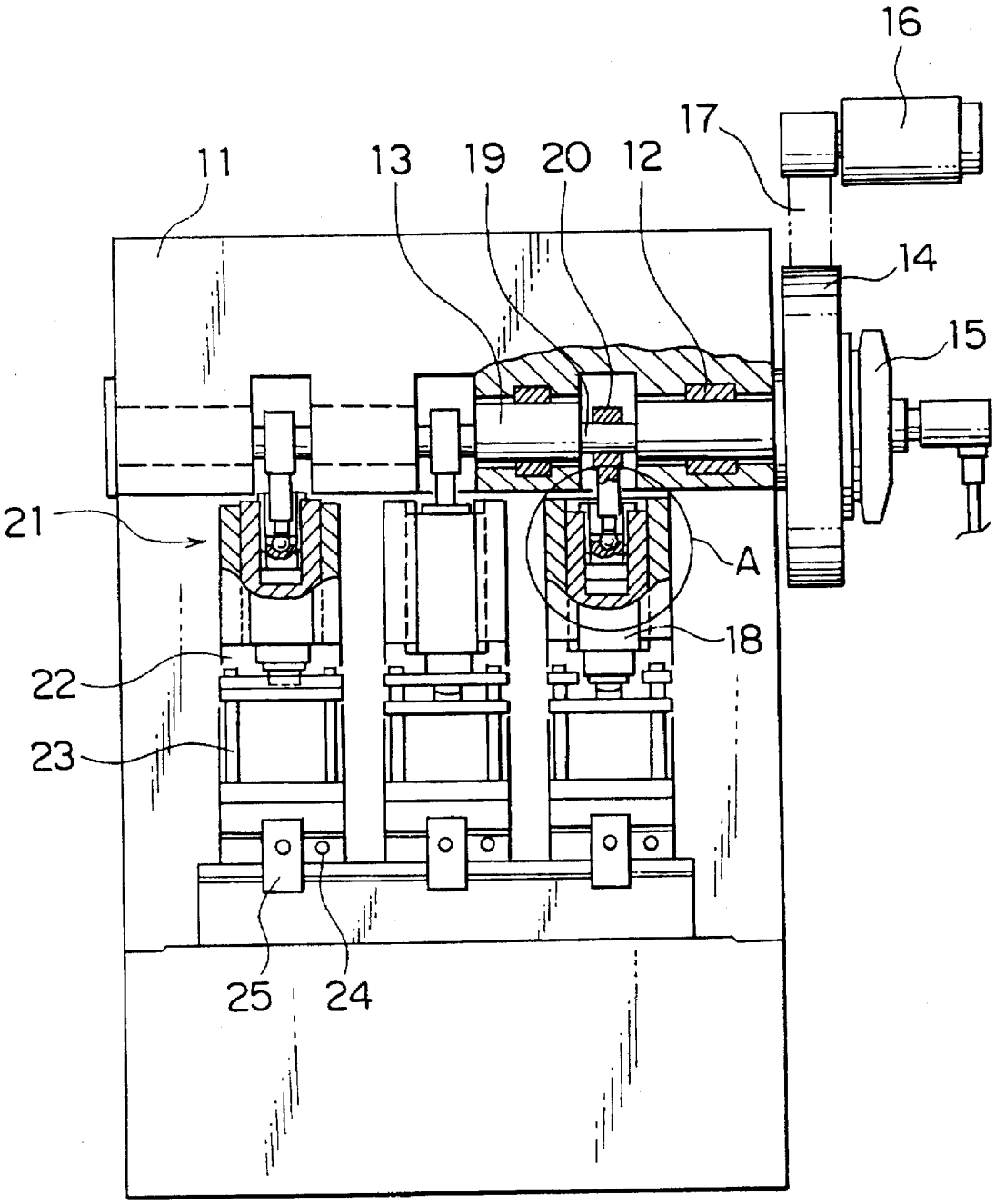
FIGS. 3 and 4 are a cross-sectional front view and a cross-sectional side view of an embodiment of this invention.
Figure 4:
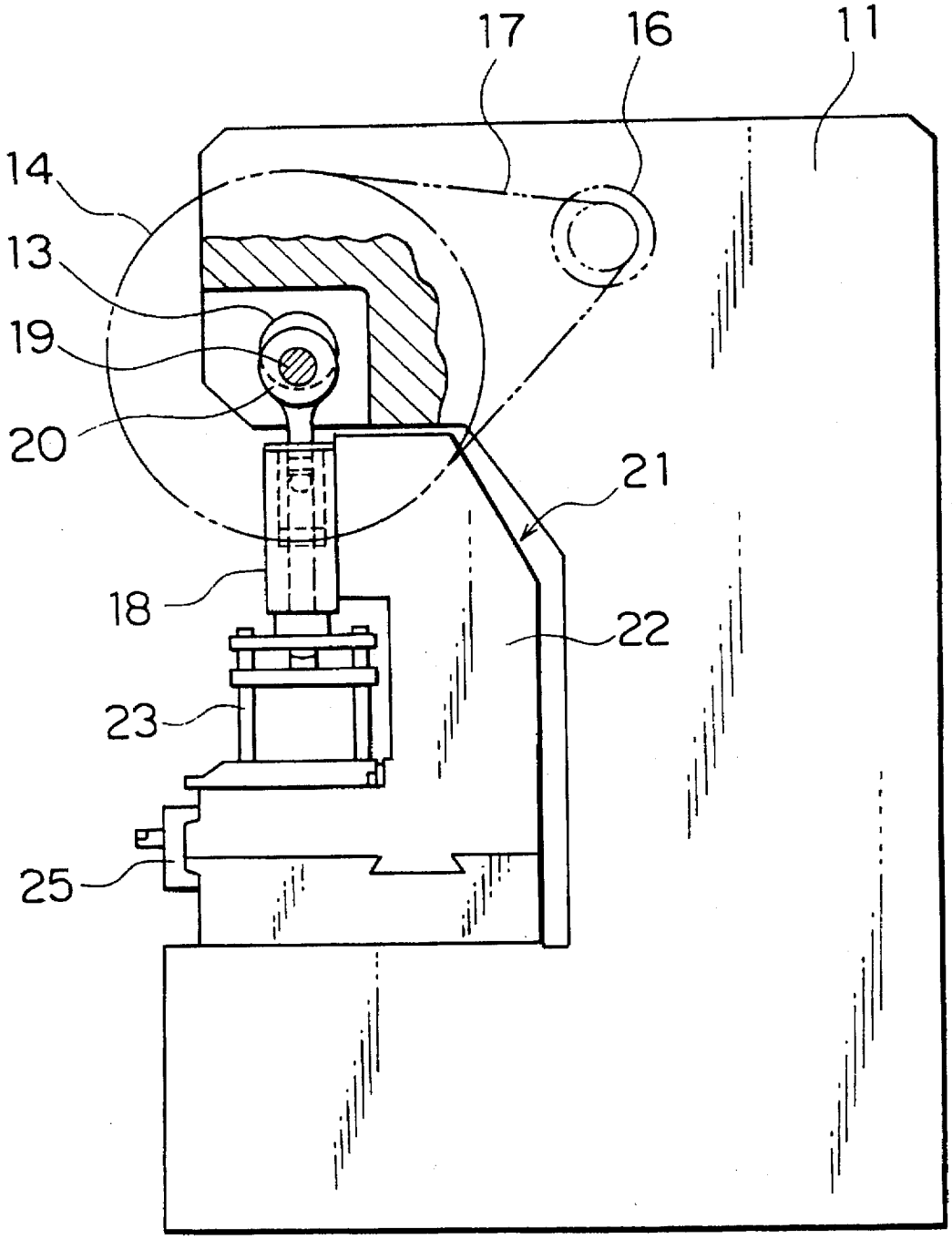
Figure 5:
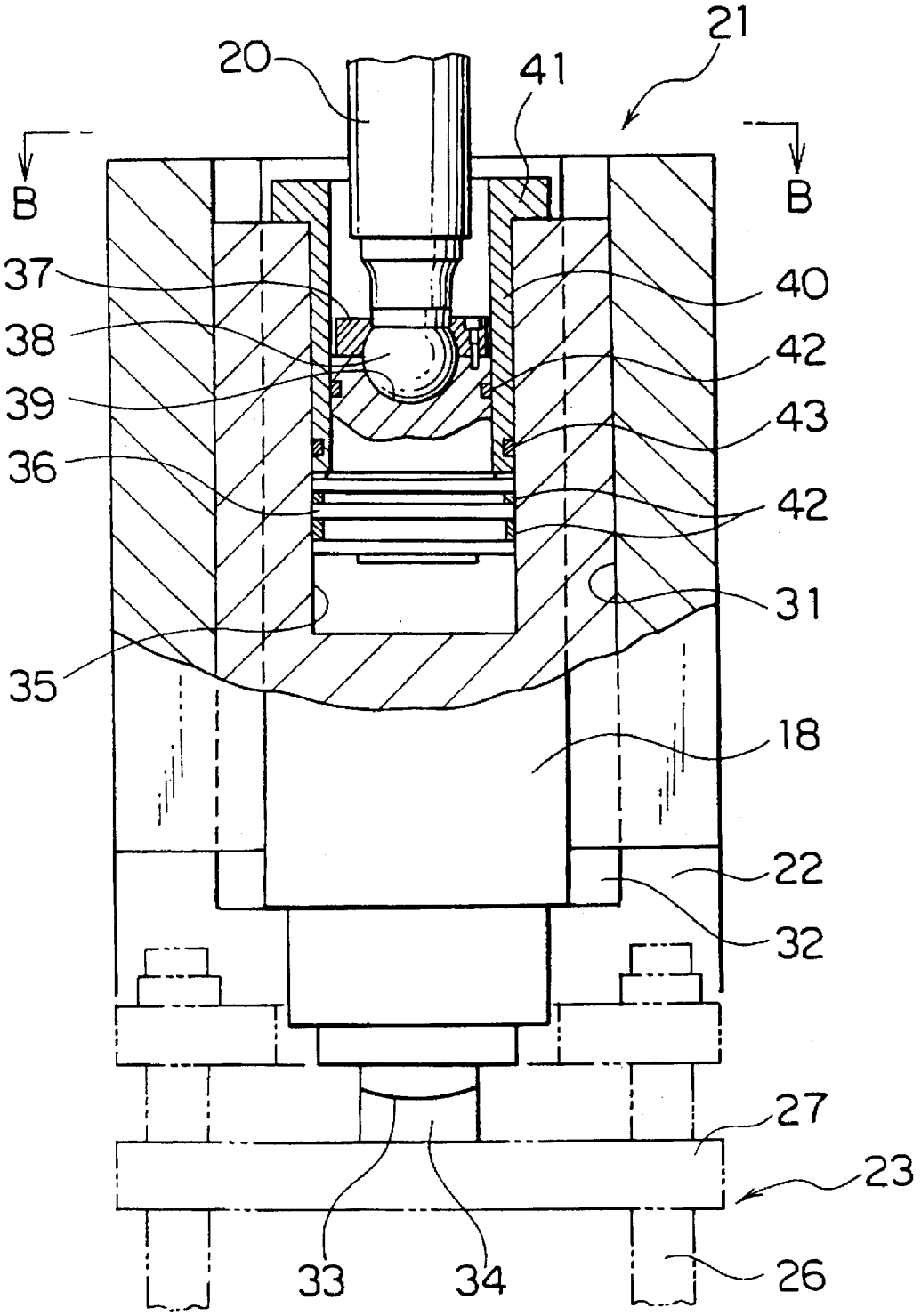
FIG. 5 is an enlarged cross-sectional front view of part A in FIG. 3.
Figure 6:
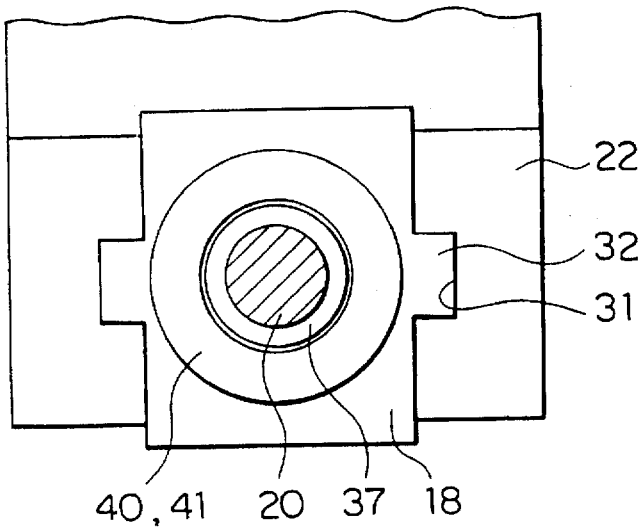
FIG. 6 is a cross-sectional view taken along line B—B and viewed in the direction shown by arrows in FIG. 5.

FIGS. 3 and 4 are a cross-sectional front view and a cross-sectional side view illustrating an embodiment of this invention, FIG. 5 is an enlarged cross-sectional front view of part A in FIG. 3, and FIG. 6 is a cross-sectional view taken along line B—B and viewed in the direction shown by arrows in FIG. 5.

In FIGS. 3 and 4, numeral 11 refers to a column or housing made of a steel material, for example, formed into a U shape in cross-section, and rotatably supporting a crank shaft 13 via a plurality of bearings 12. Numerals 14 and 15 refer to a flywheel and a clutch, respectively, both provided on an end of the crank shaft 13 and constructed so that the rotation of an electric motor 16 is transmitted to the crank shaft 13 via a belt 17.

The clutch 15 is constructed so that the rotation of the flywheel 14 is transmitted to the crank shaft 13. These component members comprises a crank press where pressure is produced by imparting linear action to the ram 18 which is constructed in such a manner as will be described later. The position shown in FIGS. 3 and 4 represents the bottom dead point of the ram 18 pushed down by a crank pin 19 via a connecting rod 20.

Numeral 21 refers to machining unit, three units of which, for example, are provided inside the column 11 in a direction in which a workpiece (not shown) is fed, for example (in the horizontal direction in FIG. 3, for example). A cassette 23 having machining means is detachably provided in a machining unit proper 22 formed in an essentially L shape, for example. On the upper part of the machining unit proper 22 provided in a vertically movable manner is the ram 18. Numeral 24 refers to a movement adjusting device, and 25 to a clamp device.

The movement of the machining unit 21 on a base provided on the column 11 in a direction in which the workpiece is fed can be adjusted, but the movement of the machining unit 21 in a direction vertical to the workpiece feeding direction can be restricted. Needless to say, the connecting rod 20 is formed in such a manner that the movement of the connecting rod 20 can be adjusted in the axial direction of the crank pin 19.

In FIGS. 5 and 6, a guide groove 31 is provided on the machining unit proper 22 in the vertical direction so that the ram 18 can be moved vertically by causing projections 32 provided on the ram 18 to engage and come into sliding contact with the guide groove 31. A working piece 34 is provided on the lower end of the ram 18 via a spherical joint 33. The cassette 23 has such a construction that a movable plate 27 fitted to the cassette 23 in a vertically movable manner via guides 26, for example, is preloaded upwardly by a spring (not shown). A predetermined machining operation can be performed by causing an upper mold (not shown) provided on the movable plate 27 to come into contact or engage with a lower mold (not shown) fixedly fitted beneath the upper mold.

A hydraulic cylinder 35 is provided on the ram 18. A piston 36 is fitted in the hydraulic cylinder 35 in a vertically movable manner, and the upper part of the piston 36 is connected to the connecting rod 20 via a connecting member 37. In this case, since the connecting rod 20 rocks as it is caused to move vertically by the crank pin 19 as shown in FIGS. 3 and 4, the lower end of the connecting rod 20 is formed into a spherical body 38, which is slidably and rotatably engaged with a semi-spherically-shaped recess 39 provided on the upper end of the piston 36.

Numeral 40 refers to a piston retainer formed into a hollow cylindrical shape and fixedly fitted to the ram 18 via a flange 41 above the hydraulic cylinder 35 and the piston 36. Numeral 42 refers to a piston ring, and 43 to a packing. An operating fluid charge/discharge ports (not shown) are provided on the lower end of the hydraulic cylinder 35, and on the intermediate portions of the hydraulic cylinder 35 facing the lower end of the piston retainer 40 so that operating fluid can be fed and discharged through these ports.

Figure 7:
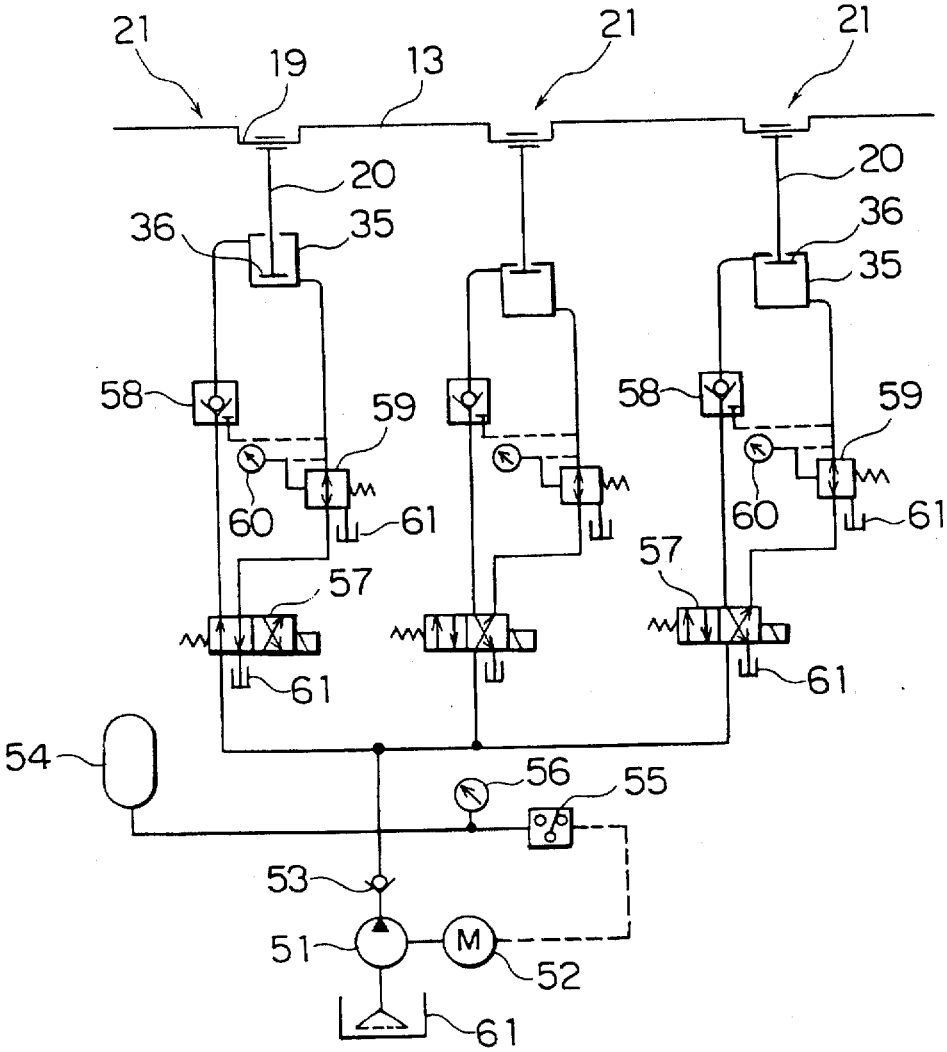
FIG. 7 is a hydraulic circuit diagram in an embodiment of this invention.

FIG. 7 is a hydraulic circuit diagram in an embodiment of this invention. Like parts are indicated by like numerals shown in FIGS. 3 through 6. In FIG. 7, numeral 51 refers to a hydraulic pump driven by a motor 52, and piping is disposed so that operating fluid of a predetermined pressure can be pressure-fed to the hydraulic cylinder 35 and an accumulator 54 via a check valve 53. Numeral 55 refers to a pressure switch that is turned on to drive the motor 52 when the pressure of operating fluid in the piping falls below a predetermined value, and turned off to stop the motor 52 when the pressure exceeds a predetermined value. Numeral 56 refers to a pressure gauge.

Numeral 57 refers to a solenoid valve connected so that the supply and discharge of operating fluid to and from the hydraulic cylinder 35 can be controlled via a check valve 58 and a pressure relief and reducing valve 59. Numeral 60 refers to a pressure gauge and 61 to a tank.

In the two right-hand machining units 21 of the three machining units 21 shown in FIG. 7, operating fluid is fed to the lower part of the piston 36 in the hydraulic cylinder 35 via the pressure relief and reducing valve 59 by shifting the solenoid valve 57 leftward by the solenoid thereof, while the operating fluid in the upper part of the piston 36 is discharged into the tank 61 via the check valve 58 and the solenoid valve 57 that have become inactive by introducing operating fluid in the pressure relief and reducing valve 59. Consequently, the hydraulic cylinder 35 moves downward with respect to the piston 36 connected to the connecting rod 20.

The one left-hand machining unit 21 in FIG. 7, on the other hand, is in a state where the solenoid valve 57 is shifted rightward by the solenoid or spring thereof. Consequently, operating fluid is supplied to the upper part of the piston 36 in the hydraulic cylinder 35 via the check valve 58 while the operating fluid in the lower part of the piston 36 is discharged into the tank 61 via the pressure relief and reducing valve 59 and the solenoid valve 57. Thus, the hydraulic cylinder 35 is shifted upward with respect to the piston 36 connected to the connecting rod 20. The relative positions of the hydraulic cylinder 35 and the piston 36 in FIG. 7 also applies to those in FIG. 3 above.

In the two right-hand machining units 21 among the three machining units 21 in FIG. 3, therefore, the ram 18 is in a state where the ram 18 can actuate the cassette 23, while the ram 18 of the one left-hand machining unit 21 is in a state where the ram 18 cannot actuate the cassette 23 because the ram 18 does not come in contact or engage with the cassette 23. In this state, when a workpiece (not shown) is index-fed from the right to the left, for example, and the crank shaft 13 is caused to rotate, all the three rams 18 move vertically, but machining is effected only in the right-hand two machining units 21, while machining is not effected in the left-hand one machining unit 21. This means that even when index-feed machining is performed with a mechanical press, such as a crank press, any particular machining unit can be selectively put into an inactive state.

Even when foreign matter enters in a machining unit 21 during operation, the index-feed machining system of this invention can prevent possible damage to component members caused as the crank is operated over a predetermined stroke. That is, operating fluid always exists in the lower part of the piston 36 in the right-hand two machining units 21 that are in an active state, as shown in FIG. 7. Consequently, when foreign matter enters in the machining unit 21, the pressure of operating fluid in the hydraulic cylinder 35 at the lower part of the piston 36 sharply rises when a ram (not shown) descends, that is, when the piston 36 and the hydraulic cylinder 35 descend.

This pressure rise actuates the pressure relief and reducing valve, shutting off the flow of operating fluid from the solenoid valve 57 and discharging the operating fluid in the lower part of the piston 36 into the tank 61. Part of the operating fluid, on the other hand, is introduced into the upper part of the piston 36 via the check valve 58. Thus, despite the descending of the connecting rod 20 and the piston 36, the hydraulic cylinder 35, that is, the ram 18 shown in FIGS. 3 and 4, is prevented from descending, and as a result, component members are prevented from being unwantedly damaged.

As the solenoid valve 57 shown in FIG. 7, by adopting a solenoid valve of a type having a neutral point that does not supply operating fluid to the hydraulic cylinder 35, it is possible to introduce operating fluid in the upper and lower parts of the piston 36 in the hydraulic cylinder 35 so as to set the piston 36 to a given position in the hydraulic cylinder 35 and arbitrarily change the machining stroke of the machining unit 21 and set the bottom dead point of the hydraulic cylinder 35 to any desired value.

Figure 8:
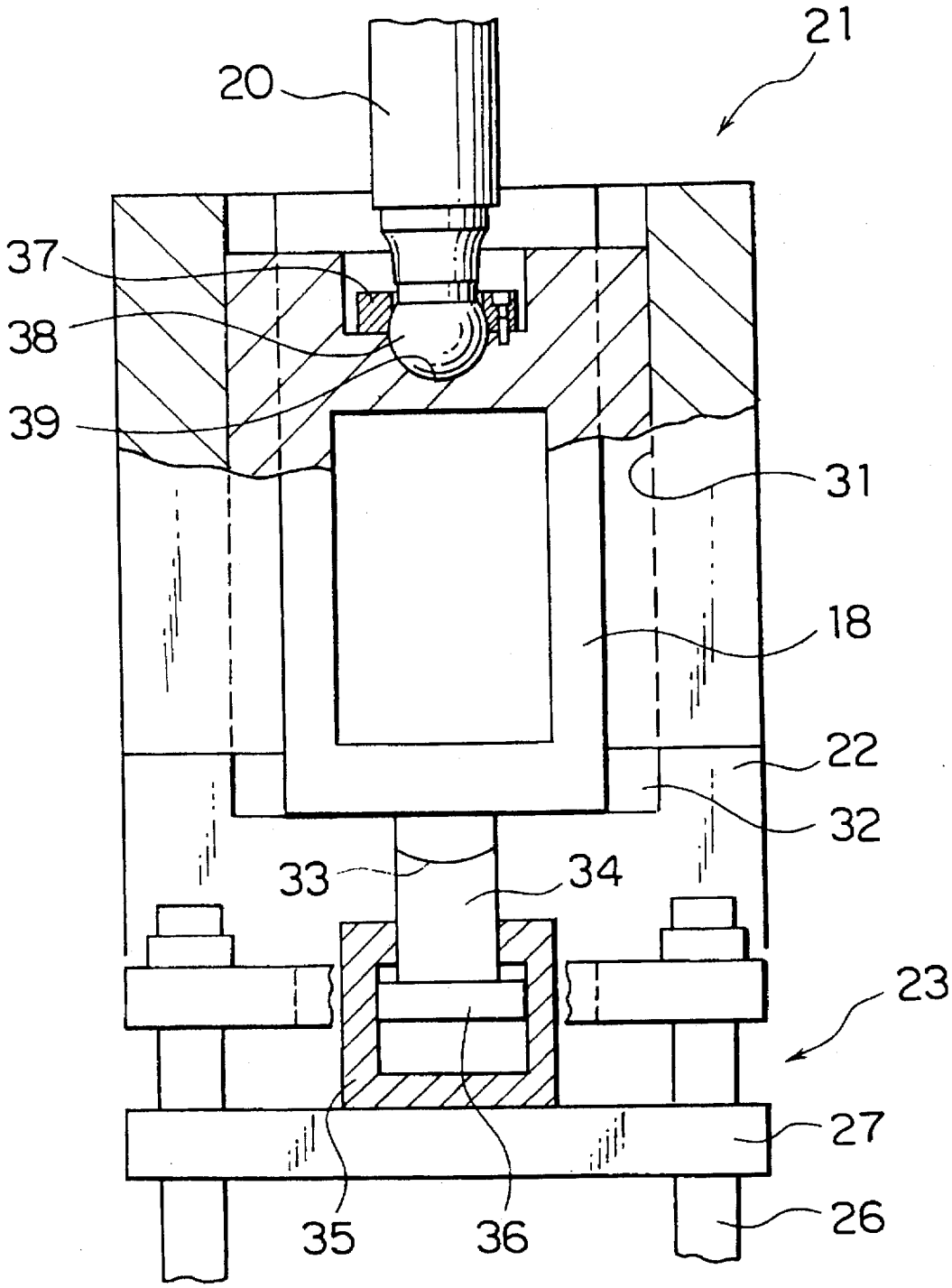
FIG. 8 is an enlarged cross-sectional front view illustrating another embodiment of this invention.

FIG. 8 is an enlarged cross-sectional front view illustrating another embodiment of this invention, corresponding to FIG. 5. Like parts are indicated by like numerals used in FIG. 5. In FIG. 8, the hydraulic cylinder 35 is provided above the movable plate 27, and the piston 36 provided in the hydraulic cylinder 35 is connected to the working piece 34. The hydraulic circuit including the hydraulic cylinder 35 is similar to that shown in FIG. 7. With the construction described above, this embodiment can carry out the same operation as the previous embodiment.

In this embodiment, description has been made on an example where three machining units are disposed. The number of machining units to be provided can be set arbitrarily, and multiple sets of index-feed machining systems can be disposed in a tandem fashion.

This invention having the aforementioned construction and operation can achieve the following effects.

(1) Since the actuating device of a machining unit imparts driving force through a mechanical mechanism, the machining unit can be operated at high speed, increasing the machining speed of the entire system.

(2) Since this invention has such a construction that a hydraulic cylinder and a piston are incorporated in a ram in a machining unit, operating fluid serves as a cushion medium to reduce impacts during machining.

(3) Since operating fluid exists in the lower part of the piston, the operating fluid can be discharged through a pressure control valve or a relief valve in an abnormality, such as entry of foreign matter, to discontinue the full-stroke operation of the ram to prevent component members from being unwantedly damaged.

(4) As the hydraulic cylinder constituting a machining unit is used only to adjust the stroke of the ram, less operating fluid is required, and thus a hydraulic pump constituting the hydraulic cylinder may be of a small capacity. The system requires a small amount of energy.

(5) The machining unit proper constituting a machining unit is of a construction to which no external force is exerted during machining. This results in a small, compact machining unit.

What is claimed is:

1. An index-feed machining system comprising a plurality of machining units, each having a cassette being able to be equipped with one of a plurality of different types of machining means, each said cassette being detachably provided on a machining unit proper and disposed at intervals of mP (m being a given positive integer, and P being a feeding pitch of a workpiece) in a direction in which the workpiece is fed corresponding to a plurality of machining processes; said machining processes being sequentially carried out on said index-fed workpiece in said machining units, the index-feed machining system further comprising a column having an eccentrically rotating shaft and having a plurality of said machining units detachably setup therein; a ram for actuating machining means is provided in a vertically movable manner on an upper end of a machining unit proper constituting said machining unit, a hydraulic cylinder is provided in said machining unit, a piston is provided in said hydraulic cylinder in a vertically movable manner, a plurality of connecting rods are provided on said column for engaging said eccentrically rotating shaft with said pistons in said machining units proper via the connecting rod and said ram, a hydraulic circuit means is provided for introducing fluid into an upper part of said cylinder to disengage said ram from said machining means, said hydraulic circuit introducing said fluid into a lower part of said cylinder to engage said ram with said machining means.

2. An index-feed machining system as set forth in claim 1, wherein a spherical body is integrally formed on a lower end of said connecting rod, and an upper end of said ram is formed into a spherical recess so as to cause said spherical body to slidably and rotatably engage with said recess.

3. An index-feed machining system as set forth in claim 1, wherein a part at which said ram and said machining means are engaged with each other is formed into a spherical surface.

4. An index-feed machining system as set forth in claim 1, wherein a plurality of machining units are detachably provided on a base of said column.

5. An index-feed machining system as set forth in claim 1, wherein a plurality of machining units are provided via a dovetail and a dovetail groove provided on a base of said column in a direction in which said workpiece is fed in such a manner that movement of said machining units in a direction in which said workpiece is fed can be adjusted, and that movement of said machining units in a direction vertical to said workpiece feeding direction can be restricted.

6. An index-feed machining system comprising a plurality of machining units, each having a cassette being able to be equipped with one of a plurality of different types of machining means, each said cassette being detachably provided on a machining unit and disposed at intervals of mP (m being a given positive integer, and P being a feeding pitch of a workpiece) in a direction in which the workpiece is fed corresponding to a plurality of machining processes; said machining processes being sequentially carried out on said index-fed workpiece in said machining units, the index-feed machining system further comprising a column having an eccentrically rotating shaft and having a plurality of said machining units detachably setup therein; a ram for actuating machining means is provided in a vertically movable manner on an upper end of a machining unit proper constituting said machining unit, a hydraulic cylinder is provided in said ram, a piston is provided in said hydraulic cylinder in a vertically movable manner, a plurality of connecting rods are provided on said column for engaging said eccentrically rotating shaft with said pistons, a hydraulic circuit means is provided for introducing fluid into an upper part of said cylinder to disengage said ram from said machining means, said hydraulic circuit introducing said fluid into a lower part of said cylinder to engage said ram with said machining means.

7. An index-feed machining system as set forth in claim 6, wherein a spherical body is integrally formed on a lower end of said connecting rod, and an upper end of said piston is formed into a spherical recess so as to cause said spherical body to slidably and rotatably engage with said recess.

8. An index-feed machining system as set forth in claim 6, wherein a part at which said ram and said machining means are engaged with each other is formed into a spherical surface.

9. An index-feed machining system as set forth in claim 6, wherein a plurality of machining units are detachably provided on a base of said column.

10. An index-feed machining system as set forth in claim 6, wherein a plurality of machining units are provided via a dovetail and a dovetail groove provided on a base of said column in a direction in which said workpiece is fed in such a manner that movement of said machining units in a direction in which said workpiece is fed can be adjusted, and that movement of said machining units in a direction vertical to said workpiece feeding direction can be restricted.

11. An index-feed machining system comprising:

a housing;

an eccentrically rotating shaft mounted in said housing a plurality of machining units positioned in said housing, each of said plurality of machining units including a separate cassette, each said cassette being accommodatable of one of a plurality of different machining means for sequentially forming a workpiece as the workpiece is passed though said housing;

ram means movable on said each machining unit for actuating said machining means of an associated said cassette by movement of said ram means, said ram means including a hollow hydraulic cylinder movably mounted on said machining unit, said ram means including a piston movable in said hydraulic cylinder;

a plurality of connecting rods, each said connecting rod connecting one said piston to said eccentrically rotating shaft;

hydraulic circuit means for supplying fluid to, and removing fluid from, said cylinder to engage and disengage said ram means from said machining means of said associated cassette.

12. An index-feed machining system as set forth in claim 11, wherein:

a spherical body is integrally formed on an end of said connecting rod, and an upper end of said piston is formed into a spherical recess so as to cause said spherical body to slidably and rotatably engage with said recess.

13. An index-feed machining system as set forth in claim 11, wherein:

a part at which said ram and said machining means are engaged with each other is formed into a spherical surface.

14. An index-feed machining system as set forth in claim 11, wherein:

said plurality of machining units are detachably provided on a base of said housing.

15. An index-feed machining system as set forth in claim 11, wherein:

said plurality of machining units are provided via a dovetail and a dovetail groove provided on a base of said housing in a feeding direction in which said workpiece is fed in such a manner that movement of said machining units in said feeding direction can be adjusted, and that movement of said machining units in a direction perpendicular to said feeding direction can be restricted.

* * * * *